United States Patent [19]

Bruveris et al.

[11] Patent Number: 4,759,171

[45] Date of Patent: Jul. 26, 1988

[54] ARRANGEMENT ON PACKING MACHINES

[75] Inventors: Vilnis Bruveris, Malmö; Lars Carlsson, Blentarp, both of Sweden

[73] Assignee: AB Tetra Pak, Sweden

[21] Appl. No.: 38,983

[22] Filed: Apr. 16, 1987

[30] Foreign Application Priority Data

Apr. 18, 1986 [SE] Sweden ..... 8601782

[51] Int. Cl.[4] ..... B65B 61/00

[52] U.S. Cl. ..... 53/563; 53/565; 493/164; 493/472

[58] Field of Search ..... 53/563, 565, 276, 272, 53/234; 493/183, 184, 165, 164, 176, 175, 472

[56] References Cited

U.S. PATENT DOCUMENTS 2,821,054 1/1958 Ritscher ..... 53/563 X
3,212,413 10/1965 Allen et al. .
3,382,644 5/1968 Vogt ..... 53/563

FOREIGN PATENT DOCUMENTS 335495 5/1971 Sweden .

*Primary Examiner*—James F. Coan
*Attorney, Agent, or Firm*—Burns, Doane, Swecker & Mathis

[57] ABSTRACT

An arrangement for the retaining of container blanks (1) in a predetermined correct position on mandrels on a packing machine of the type which manufactures filled and closed packing containers from tubular container blanks and which comprises a stepwise rotatable mandrel wheel which is the bearer of mandrels distributed around the mandrel wheel which are intended to move container blanks applied to the mandrels in correct position between successive processing stations so as to achieve a bottom closure of the blanks. The arrangement comprises clamping elements pressed against the mandrels in the form, for example, of a lever which is adapted to be pivotable in a bracket at one lateral surface of the mandrel. The mandrel includes an upper clamping arm pressed against the mandrel and a lower maneuvering arm rigidly connected with the clamping arm as well as a spring element arranged at the top of the clamping arm (14). The clamping element (14) and the spring element can be disengaged from the mandrel through the effect of stops located at one or more of the stations which are adapted to act upon the maneuvering arm so that the latter through a forced pivoting movement adjusts the clamping arm (16) and the spring element (16) into a position wholly or partly disengaged from the mandrel.

6 Claims, 2 Drawing Sheets

I
II
III
IV
V
1
2
3
4
5
6
7
8
9
10
11
12
13

ARRANGEMENT ON PACKING MACHINES

BACKGROUND AND SUMMARY OF THE INVENTION

The present invention relates to an arrangement on a packing machine of the type which manufactures filled and closed packing containers from tubular container blanks and which comprises, among other things, a stepwise rotatable mandrel wheel having a plurality of radial mandrels distributed around the mandrel wheel which are intended to move container blanks applied to the mandrels between successive processing stations so as to achieve a bottom closure of the blanks. More particularly the invention relates to an arrangement of the type which comprises clamping elements pressed against the mandrels for the retaining of the container blanks in a previously determined correct position on the mandrels during their stepwise movement between the bottom forming stations around the mandrel wheel.

Containers of the ridge or gable-top type have been known for a long time in packing technique. They are manufactured usually from container blanks prepared beforehand which appropriately can be provided with a creaseline pattern in order to facilitate the forming of the containers through folding of the panels, representing the top and bottom closures to their final position. Frequently the blanks are coated with a thermoplastic material, e.g. polyethylene, which is used on the one hand to make the container liquid-tight and on the other hand to allow the sealing of the container by heat and pressure (so-called hot-sealing) so that it permanently retains its intended final form.

The packages described above are used primarily as packages for liquid goods, e.g. milk or similar dairy products, and over the years different machines for the manufacture of the packages have been designed. A number of these machines comprise one or more intermittently driven mandrel wheels, usually arranged in pairs, with mandrels on which the container blanks are attached and moved between different processing stations located around the mandrel wheel or wheels, so as to achieve a liquid-tight bottom closure on the blanks. In order to make it possible to provide such a closure it is necessary not only that the container blanks should be applied to the mandrels in a correctly adapted position with regard to the actual crease line pattern, but also that the blanks so applied should be maintained in this position during the movement between the bottom-forming operations. Accordingly any radial displacements, which may be caused for example by the pressing forces acting upon the container blanks during hot-sealing, ought to be counter-acted as long as possible or preferably prevented. On certain known packing machines such a position fixing of the blanks is provided with the help of so-called mandrel stops in the form of a stop dog or stop element, manually displaceable along a radial sliding groove in the mandrels and lockable in optional positions, which defines the correct furnishing length for the blanks.

One disadvantage of these known mandrel stops is of course that on resetting of the machine from one package size (container length) to another it is necessary to individually readjust all of the stop dogs. This is very time-consuming process and involves unnecessarily lengthy machine stoppages and, consequently, large production losses. Furthermore, mandrels provided with sliding grooves are relatively difficult to keep clean of dirt, and debris which tends to accumulate and deposit in the kind of recesses which such grooves.

It is an object of the present invention, therefore, to overcome these disadvantages of the known technique regarding mandrel stops.

This object is achieved in accordance with the invention in that a position-fixing arrangement for container blanks on a packing machine of the type described above has the clamping elements being moveable with the help of stops at one or more of the processing stations for at least a partial disengagement of the clamping elements from the container blanks.

The invention together with advantageous practical details for realization of the same will be explained in greater detail in the following with reference to the attached drawings on which:

DETAILED DESCRIPTION OF A PREFERRED EMBODIMENT

Figure 1:
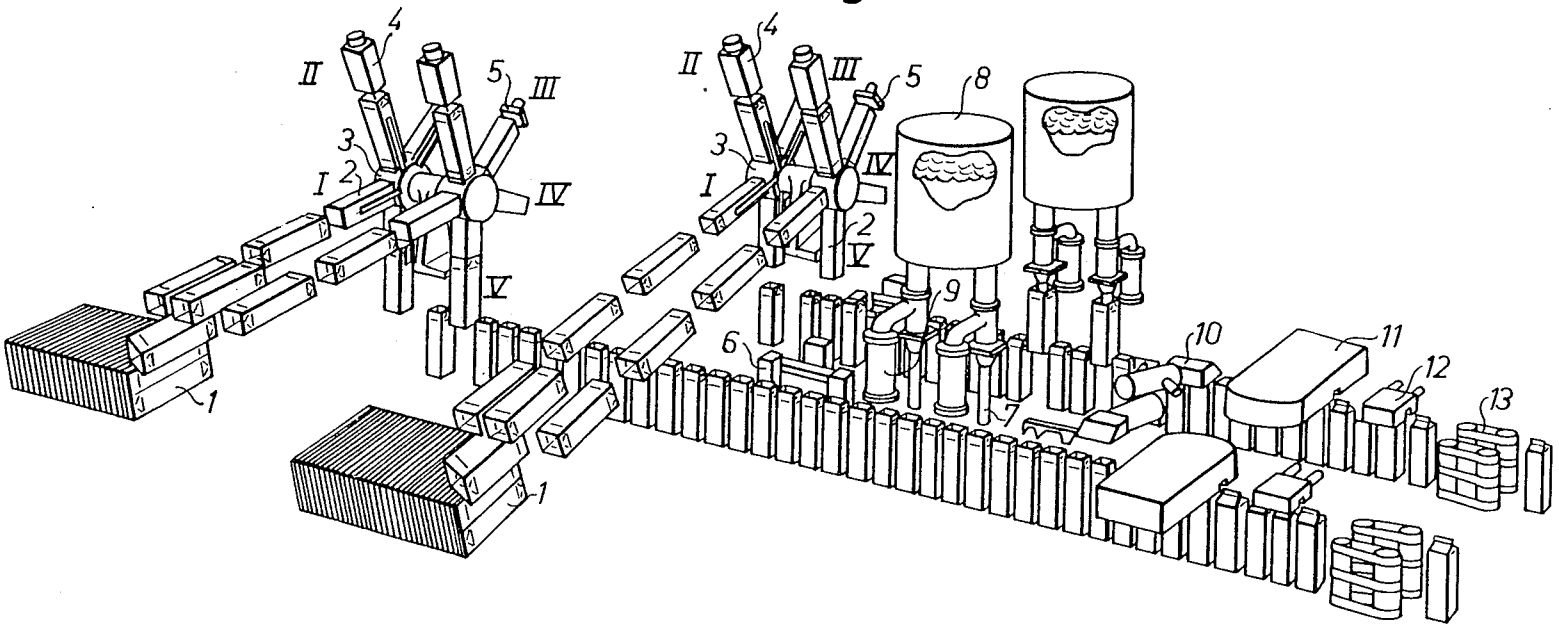
FIG. 1 shows schematically a packing machine which uses an arrangement in accordance with the invention, and FIGS. *2a–2c* illustrate in greater detail the arrangement used in FIG. 1 during different states of operation.

The arrangement in accordance with the invention is intended for the retaining of packing container blanks applied to or carried by mandrels during the forming and sealing of package bottoms of the type comprising a number of panels separated by means of crease lines which are folded together so that they partly overlap one another and are sealed with the help of heat and pressure (so-called hot-sealing).

The arrangement is usable on a packing machine of the type disclosed in Swedish Pat. No. 361857, to which reference is made. This type of packing machine is fed with tubular, flattened blanks 1 or converts a supply of material web into tubular, flattened blanks. The blanks are manufactured from a flexible packing laminate which comprises a relatively rigid carrier layer of, e.g., paper coated on both side with thermoplastic, liquid-tight and sealable material. The blanks are provided with a number of crease lines so as to be divided in a known manner into side wall panels as well as bottom and top wall panels. The blanks, on being fed out from the magazine, are raised from the collapsed, substantially flat shape to a substantially square cross-sectional shape. Subsequently, they are conveyed in their longitudinal direction and are applied to a mandrel 2, corresponding to the shape raised of the blanks, on a mandrel wheel 3. The mandrel wheel may be a single or double, wheel and every machine may comprise one or more mandrel wheels. When the blank has been applied to or received on a mandrel 2, the mandrel wheel 3 is turned a step so that the bottom folding panels of the blank projecting at the end of the mandrel can be heated by means of a bottom heater 4, which, preferably with the help of hot air, heats the thermoplastic material layer of the bottom wall panels to softening temperature which is suitable for sealing. On continued stepwise movement of the mandrel wheel 3, a folding of the heated bottom wall panels takes place so that these panels overlap one another and form a substantially plane bottom which in subsequent processing is compressed with the help of a pressure device 5 and cooled, so that the panels are sealed in water-tight manner to one aother. After further turning of the mandrel wheel 3 the liquid-tight blank provided with the sealed bottom can be pulled vertically downwards to a conveyor which transports the blank in longitudinal direction of the machine. In the procedure, the blank will pass a top pre-folder 6 which slightly pre-folds the top wall panels. Thereafter, the blank is placed under a filling pipe 7 through which contents are supplied in the required quantity to the packing container from a contents vessel 8 with the help of a pump 9. The packing container continues along the conveyor to a stop in the subsequent station where a top heater 10 of the hot air type heats the top wall panels of the packing container so that the thermoplastic layers obtain or reach a suitable sealing temperature. The sealing of the top material of the packing container takes place with the help of the top sealer 11, whereupon the filled and closed packing containers via the dating device 12 and the feed-out conveyor 13 are discharged from the packing machine in finished condition. As pointed out previously, it is important that the container blanks 1 should be applied to the mandrels in correct position with regard to the crease line pattern facilitating the folding in of the bottom panels and be retained in this position with the greatest possible resistance against possible displacements during the movement between all the processing stations located around the mandrel wheel 3 so as to ensure the best possible bottom closure. This position fixing in accordance with the invention is achieved with the help of an arrangement which is indicated schematically on the machine shown in FIG. 1 and which is illustrated in greater detail in FIGS. 2a–2c, to which reference will be made in the continued description. As is evident from FIG. 2a, which shows the working position in connection with the actual application of the container blank 1 to the mandrel 2, the arrangement in accordance with the invention comprises a clamping element pressed against the mandrel 2 which in the present example is shown as a lever 14 which is adapted so as to be pivotable in a bracket 15 supported on one lateral surface of the mandrel. The lever 14 has an upper clamping arm 14a loaded or pressed against the mandrel and a lower maneuvering arm 14b rigidly connected with the clamping arm. The load against the clamping arm 14a may be achieved, for example, with the help of a spring (not shown) fixed in the bracket 15 whose spring force presses the clamping arm 14a against the mandrel 2 so that the clamping arm in the absence of an external counter-load counterweight against the maneuvering arm 14b, rests with upper part against the mandrel 2 under a predetermined pressure. The choice of load or spring in itself is in accordance with the art, but it is important according to the invention that the load or spring chosen should be dimensioned so that the contact pressure, which the clamping arm 14 exerts on the mandrel 2 without a counter-load on the maneuvering arm 14b is sufficiently large to safely retain a container blank 1 applied to the mandrel 2 and clamped between the mandrel and the clamping arm, when the mandrel moves step-by-step between the processing stations around the mandrel wheel 3 and subjects the container blank 1 to the working operations required for the bottom closure.

The clamping arm 14a is provided with a fishhook-shaped leaf spring element 16 whose straight part 16a rests mainly flat against, and with the help of screws or rivets is attached to, the clamping arm. The top part 16b extends around the top edge of the clamping arm to rest with its curved, active surface against the mandrel 2. The curved top part 16b of the spring element is dimensioned so that it not only encloses the top edge of the clamping arm but also extends a little beyond the clamping arm with the active surface when the straight part 16a rests flat against the clamping arm 14 as will be the case when, owing to a corresponding counter-load against he manoeuvring arm 14b, the clamping arm is pivoted, or disengaged from the mandrel 2. When the counterload against the maneuvering arm 14b ceases and the clamping arm, through the effect of the spring fixed in the bracket, is pressed against the mandrel 2, the projecting active surface of the curved top part 16b of the spring element 16 consequently will strike or contact against the surface of the mandrel and, during continued enforced pivoting in of the clamping arm against the mandrel, successively force the free section of the straight part 16a of the spring element situated above the said screws or rivets successively to bend outwards from the clamping arm over a distance which by and large, corresponds to the distance by which, the non-loaded active surface 16b of the spring element extends beyond the top edge of the clamping arm. The spring element bent out in this manner consequently will exercise a spring force directed against the mandrel with which the curved top part rests pressed against the mandrel. This means, as will be readily understood, that a certain intermediate clamping position is possible, namely when the counter-load acting upon the maneuvering arm 14b is such that the clamping arm 14a is barely disengaged from the mandrel 2, while the spring element, thanks to the "overdimensioned" curved top part 16b continues to press against the mandrel 2 with a spring force caused by the enforced bending out.

Figure 2A:
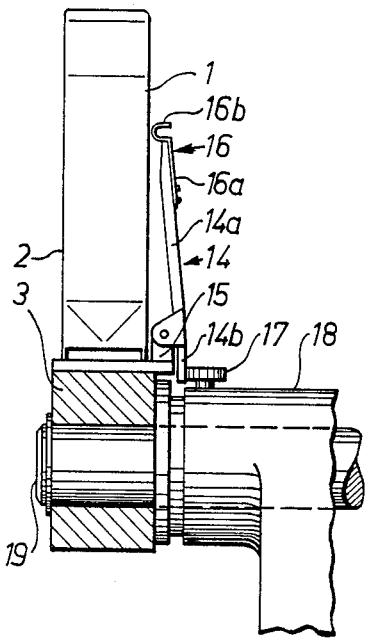

The abovementioned load against the maneuvering arm 14b can be achieved in accordance with the invention with the help of stops 17 co-operating with the maneuvering arm and located at selected positions around the mandrel wheel 3 which to a greater or lesser extent prevent the free or unimpeded passing by of the maneuvering arm, and to a corresponding degree, force the maneuvering arm, and thereby the clamping arm, to carry out a pivoting movement against the effect or force of the spring fixed in the bracket each time the manoeuvring arm will pass such a stop during the stepwise movement of the mandrel 2. Such stops may be constituted, for example, of small maneuvering wheels fixed to the machine frame, for example a bearing housing 18 for the driving shaft 19 of the mandrel wheel 3, in direct association with those stations around the mandrel wheel 3 where a certain disengagement of the clamping arrangement from the mandrel 2 may be desirable. In FIG. 2a by way of example is shown such a station, that is to say the station at which the container blank 1 is applied to the mandrel 2, and at which it is desirable, therefore, that the clamping arm 14a as well as the spring element 16 should be completely disengaged from the mandrel 2. The corresponding stop or wheel 17 is positioned so therefore, that during the actual application action a position is forced upon the maneuvering arm 14b when it strikes against the stop 17 at the actual instant of the application of the blank to the mandrel, which is such that the clamping arm is moved a sufficient distance from the mandrel 2 to permit complete disengagement also of the active surface of the spring element 16, as illustrated. Thus, free application or of the container blank 1 which, in connection with the packing machine described here, is applied to the mandrel in such a position that the crease line pattern facilitating the folding in of the bottom is directly outside the free end surface of the mandrel 2.

Figure 2B:
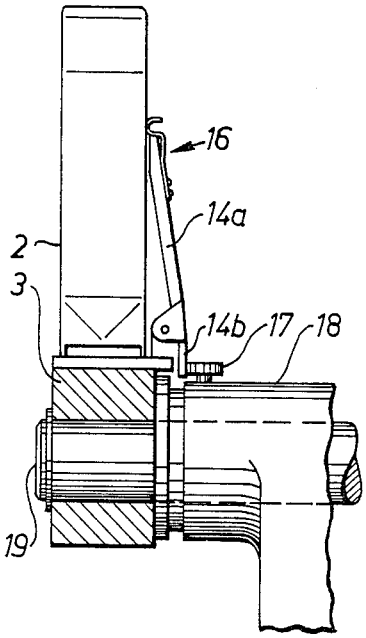
Figure 2C:
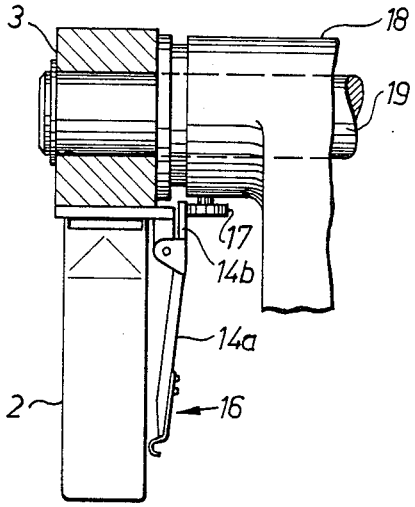

Another station, where disengagement of the device from the mandrel 2 on the packing machine described above may be desirable, corresponds to the position marked II in FIG. 1 which is illustrated in greater detail in FIG. 2*b*. At this station, as mentioned earlier, a heating of the bottom panels on the container blank 1, which can be folded in to overlap one another, takes place with the help of the bottom heater 4. The heater 4, which is movable to a position against the mandrel 2 and to the bottom of the container, is provided with internal stops which are arranged so, that as the heater moves towards the mandrel 1 they strike against the container blank 1 and displace the same to such a position on the mandrel 2 that the crease line pattern ends up accurately level with the top edge of the mandrel when the heater is in its bottom position. To make possible this radial position adjustment of the container blank 1 it is important that the clamping effect upon the container blank by the clamping device at this heating station should be adjusted so that the container blank 1 can be shifted relatively easily to the desired position on the mandrel 2, but at the same time the counter-force exercised by the clamping device against this axial displacement is to be great or large enough to prevent a continued sliding on of the container blank 1 which might cause the crease line pattern to end up below the upper edge of the mandrel. Such an adjusted clamping effect is obtained or provided in accordance with the invention in that the stop or wheel 17 arranged at this heating station (which corresponds to position II in FIG. 1) is dimensioned or positioned so that by striking against the maneuvering arm 14*b*, the clamping arm 14*a* is forced to assume the intermediate clamping position described earlier and is shown in FIG. 2*b* and which permits the container blank 1 on the mandrel 2 is subjected solely to the clamping effect from the spring element 16, since in this position the clamping arm 14*a* is completely disengaged from the container blank 1.

A further station around the mandrel wheel 3 on the packing machine shown in FIG. 1, where a disengagement of the clamping device in accordance with the invention from the container blank 1 is desirable, is, of course, the station at which the container blank is to be withdrawn from the mandrel 2. This station corresponds to the position in FIG. 1 marked III and which is shown in more detail in FIG. 2*c*. In this position, as in the application station described previously with reference to FIG. 2*a*, it is desirable that the clamping device in accordance with the invention be wholly disengaged from the container blanks, so as to make the withdrawal of the container blanks as simple as possible. The corresponding stop or wheel 17, therefore, is arranged so, just as in the application station, that by acting upon the manoeuvring arm 14*b* it forces the clamping arm 14*a* to such a pivoting position that both the clamping arm 14*a* and the spring element 16 are out of contact with the container blank 1.

Although the present invention has been described herein in the context of its application as a container handling arrangement, it will be appreciated that other applications of the present invention are possible. Furthermore, the references to the directions of movements of the various elements are intended as exemplary and not limiting. Thus, although a preferred embodiment is illustrated and described herein, modifications and variations of the present invention are possible in light of the above teachings and with the purview of the appended claims without departing from the spirit and intended scope of the invention.

What is claimed is:

1. An arrangement on a packing machine of the type which manufactures filled and closed packing containers from container blanks and which includes a stepwise rotatable mandrel wheel having a plurality of mandrels distributed around the mandrel wheel and supported thereon, the mandrels movable between successive processing stations to provide a bottom closure on the blanks, clamping elements for clamping the container blanks against the mandrels and retaining the blanks on the mandrels during the movement between the processing stations around the mandrel wheel comprising stop elements for actuating said clamping elements so as to permit at least a partial disengagement of the clamping elements from the container blanks, said clamping elements including a lever having an upper clamping arm provided with a spring element at a top edge of the clamping arm.

2. An arrangement in accordance with claim 1, wherein said lever is pivotable in a bracket at one lateral surface of the mandrels.

3. An arrangement in accordance with claim 2, wherein the lever comprises an upper clamping arm loaded against the mandrel and a lower maneuvering arm rigidly connected with the clamping arm, the clamping arm being pressed against the mandrel by a spring fixed in the bracket.

4. An arrangement in accordance with claim 1, wherein the spring element is a fishhook-shaped leaf spring with a straight part being mainly flat against and attached to the clamping arm, a top part of the leaf spring extends around the top edge of the clamping arm with a curved, active surface against the mandrel.

5. An arrangement in accordance with claim 4, wherein the top part of the spring element is dimensioned to wholly enclose the top edge of the clamping arm and extend beyond the clamping arm with the active surface when the straight part is against the clamping arm.

6. An arrangement on a packing machine of the type which manufactures filled and closed packing containers from container blanks and which include a stepwise rotatable mandrel wheel having a plurality of mandrels distributed around the mandrel wheel and supported thereon, the mandrels movable between successive processing stations to provide a bottom closure on the blanks, clamping elements for clamping the container blanks against the mandrels and retaining the blanks on the mandrels during the movement between the processing stations around the mandrel wheel comprising stop elements for actuating said clamping elements so as to permit at least a partial disengagement of the clamping elements from the container blanks, wherein said stop elements comprise maneuvering wheels fixed to a bearing house for the driving shaft of the mandrel wheel.

* * * * *